United States Patent [19]

Köbler et al.

[11] Patent Number: 5,005,476

[45] Date of Patent: Apr. 9, 1991

[54] INKING UNIT

[75] Inventors: Norbert Köbler, Beindersheim; Helmut Puschnerat, Worms, both of Fed. Rep. of Germany

[73] Assignee: Albert-Frankenthal AG, Frankenthal, Fed. Rep. of Germany

[21] Appl. No.: 551,031

[22] Filed: Jul. 11, 1990

Related U.S. Application Data

[63] Continuation of Ser. No. 289,557, Dec. 22, 1988, abandoned.

[30] Foreign Application Priority Data

Jan. 9, 1988 [DE] Fed. Rep. of Germany ..... 3800412

[51] Int. Cl.[5] ..... B41F 31/04; B41F 31/06; B41F 31/32; B41L 27/06

[52] U.S. Cl. ..... 101/363

[58] Field of Search ..... 101/350, 363, 366, 365, 101/207-210, 148, 157, 169, 351, 352; 118/410-414, 259, 261, 262, 212

[56] References Cited

U.S. PATENT DOCUMENTS

| | | | |
|---|---|---|---|
| 3,044,396 | 7/1962 | Aller | 101/157 |
| 3,533,833 | 10/1970 | Takahashi | 101/363 X |
| 4,559,871 | 12/1985 | Kutzner et al. | 101/366 |

*Primary Examiner*—J. Reed Fisher
*Attorney, Agent, or Firm*—Edwin D. Schindler

[57] ABSTRACT

In the context of an inking unit with at least one pitted roll which is provided with an ink chamber doctor unit whose preferably two doctor blades arranged with a spacing in the peripheral direction of the roll and which delimit an ink chamber between them, the invention makes it possible to use a relatively small amount of ink if a rotatable fountain roll is mounted in the ink chamber to engage the pitted roll.

13 Claims, 3 Drawing Sheets

11
13
49
50
12
44
27
42
43
56
45

INKING UNIT

This application is a continuation of application Ser. No. 07/289/557, filed Dec. 22, 1988, now abandoned.

BACKGROUND OF THE INVENTION

The invention relates to a printing press inking unit, and more particularly an inking unit guaranteeing a short ink path from an ink chamber or fountain to a cylinder with the printing image carrier, comprising a pitted roll provided with an ink chamber doctor arrangement having two doctor blades mounted with a mutual offset about the periphery of the pitted roll and preferably carried on a doctor mount so as to delimit an ink chamber.

In known arrangements of this type inking of the pitted roll is only able to take place when the ink chamber is completely full so that measures have to be taken to see that the ink is supplied to the ink chamber under a gage pressure. For this purpose it is then necessary to have an ink pump which causes the ink to circulate. In such an arrangement there is then a comparatively large body of circulating ink, something that is uneconomic and undesired if only a small amount of ink is to be used for printing. Furthermore the means for supplying ink to the ink chamber under pressure render the system expensive.

SHORT SUMMARY OF THE INVENTION

Accordingly one object of the present invention is to design cheap and simple means for modifying an inking unit of the type described so that it may be operated with a small amount of ink.

In order to achieve these or other aims appearing from the present specification and claims, the unit comprises a rotatable fountain roll able to be brought into engagement with the pitted roll.

There is then the advantage that the ink chamber only requires a filling of ink free of pressure up to a level which ensures that the fountain roll reaches the ink. There is the further advantage that there is no necessity for means for supplying ink under pressure to the ink chamber and for causing the ink to circulate. In fact, it is possible for the arrangement to make do with a minimum amount of ink and it is economic in all cases where only a small amount of ink is needed, as for example in the case of single print systems. Nevertheless however the fountain roll provided in the ink chamber ensures a complete, bubble-free filling of the pits of the pitted roll with ink.

As part of a further useful development of the invention the fountain roll may be arranged so that it is circumferentially supported in half-shells provided in the ink chamber, which are able to be adjusted in a radial direction in relation to the pitted roll. This type of bearing for the pitted roll leads to the advantage of not requiring any extra space in the axial direction. The fountain roll may thus extend along the entire length of the respectively associated ink chamber. The adjustability of the bearing shells makes possible a reset of the fountain roll to take up doctor blade wear and thus guarantees reliable engagement of the fountain roll on the pitted roll.

In accordance with a further advantageous feature of the invention the half-shells receiving the fountain roll have lateral guide rails fitting into associated guide grooves and have an underlying adjusting device provided in the doctor mount and containing an outwardly acting thrust with a driving spring piston. This feature involves the advantage that there is an automatic reset and engagemnet of the fountain roll to ensure that it is in contact with the associated pitted roll.

A further feature of the invention is such that the fountain roll has means for driving it at a speed which is less than the speed of the pitted roll but in the same direction as the pitted roll. This measure ensures that the ink adhering to the fountain roll is drawn into the gap between the pitted roll and the fountain roll and at the same time is drawn out, something that involves a particularly reliable inking of the pitted roll.

In order to provide for a positive drive of the fountain roll the latter may have a ring of teeth cut into its circumference to mesh with a drive wheel arranged in the ink chamber, such drive wheel being connected via a glanded drive shaft with a drive motor arranged outside the ink chamber. This feature considerably reduces structural complexity, more especially in the case of a number of ink chambers arranged side by side.

It is convenient if the fountain roll is in the form of a metal roll, this simplifying supporting it on its periphery and the cutting of a ring of teeth as mentioned.

Further advantageous features and convenient developments of the invention will be gathered from the ensuing account of one working embodiment thereof referring to the accompanying drawings.

LIST OF THE FIGURES OF THE DRAWINGS

DETAILED DESCRIPTION OF EMBODIMENT OF THE INVENTION

Figure 1:
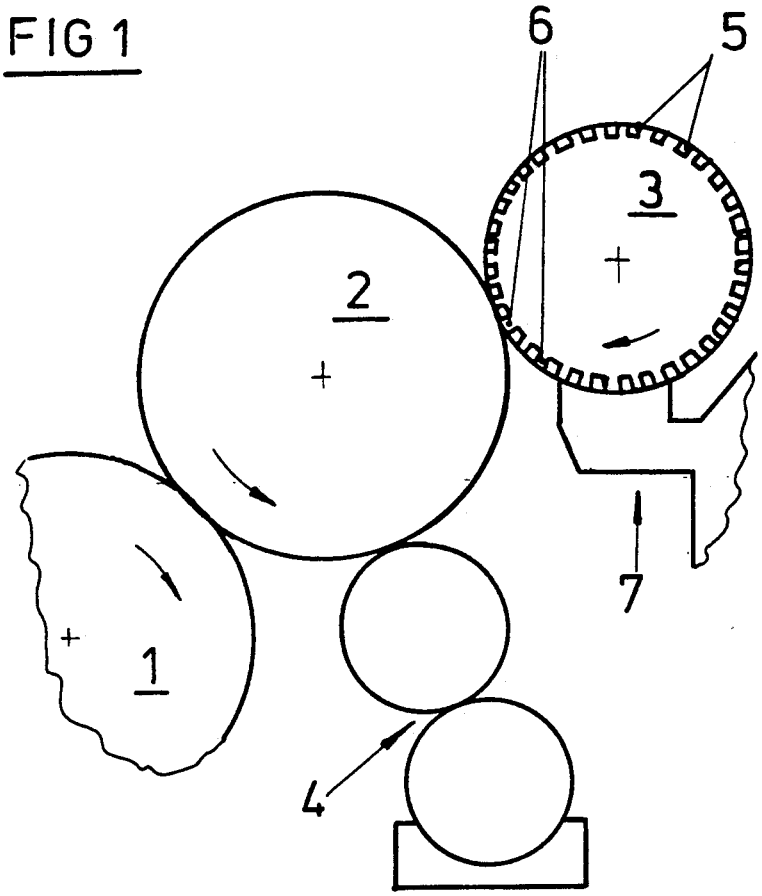
FIG. 1 shows the inking unit of the invention, which is designed to provide a short ink path from the ink chamber to the printing image carrier, for a web feed offset litho press.

The inking unit with a short ink path shown in FIG. 1 includes a rubber coated form roll 2 cooperating with the plate cylinder 1 of the same diameter and of a pitted roll 3 cooperating with the form roll 2 and having a smaller diameter than it. In the case of the offset press presently being considered the form roll 2 cooperates at the same time with a dampening unit generally referenced 4. The circumference of the pitted roll 3, which may have a metal core with a ceramic coating, is provided with pits 5 shown on an exaggerated scale in FIG. 1 and lands 6 separating them from each other. These pits 5 are filled with ink and the lands are wiped by the doctor arrangement so that there is an exact metering of the ink dictated by the capacity of the pits 5. The supply of ink to the pitted roll 3 and the wiping off of the ink are ensured by means of an ink chamber doctor arrangement generally referenced 7 in FIG. 1.

It is possible to have a number of ink chamber doctor units 7 placed side by side along the length of the pitted roll 3, as for instance two such units each occupying one half of the length of the roll. It would however also be possible, in the case of a press with more than two plates occupying different amounts of the breadth of the press, to have one unit 7 for each plate. The use of a number of ink chamber doctor units facilitates the operation of the press and makes it possible for a zone of the ink supply system to be inactivated.

Figure 2:
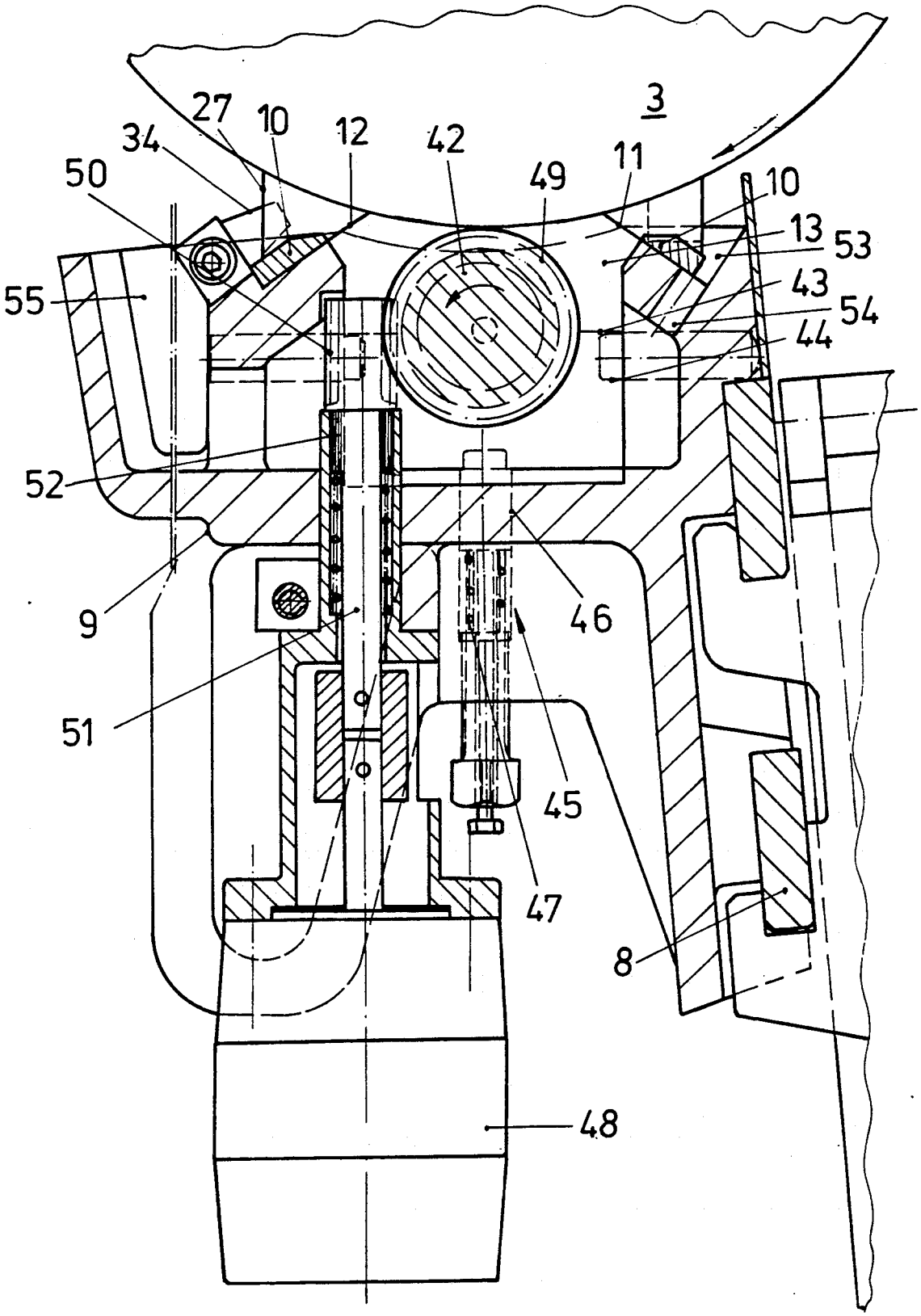
FIG. 2 is a radial section taken through an ink chamber doctor arrangement associated with the pitted roll.
Figure 3:
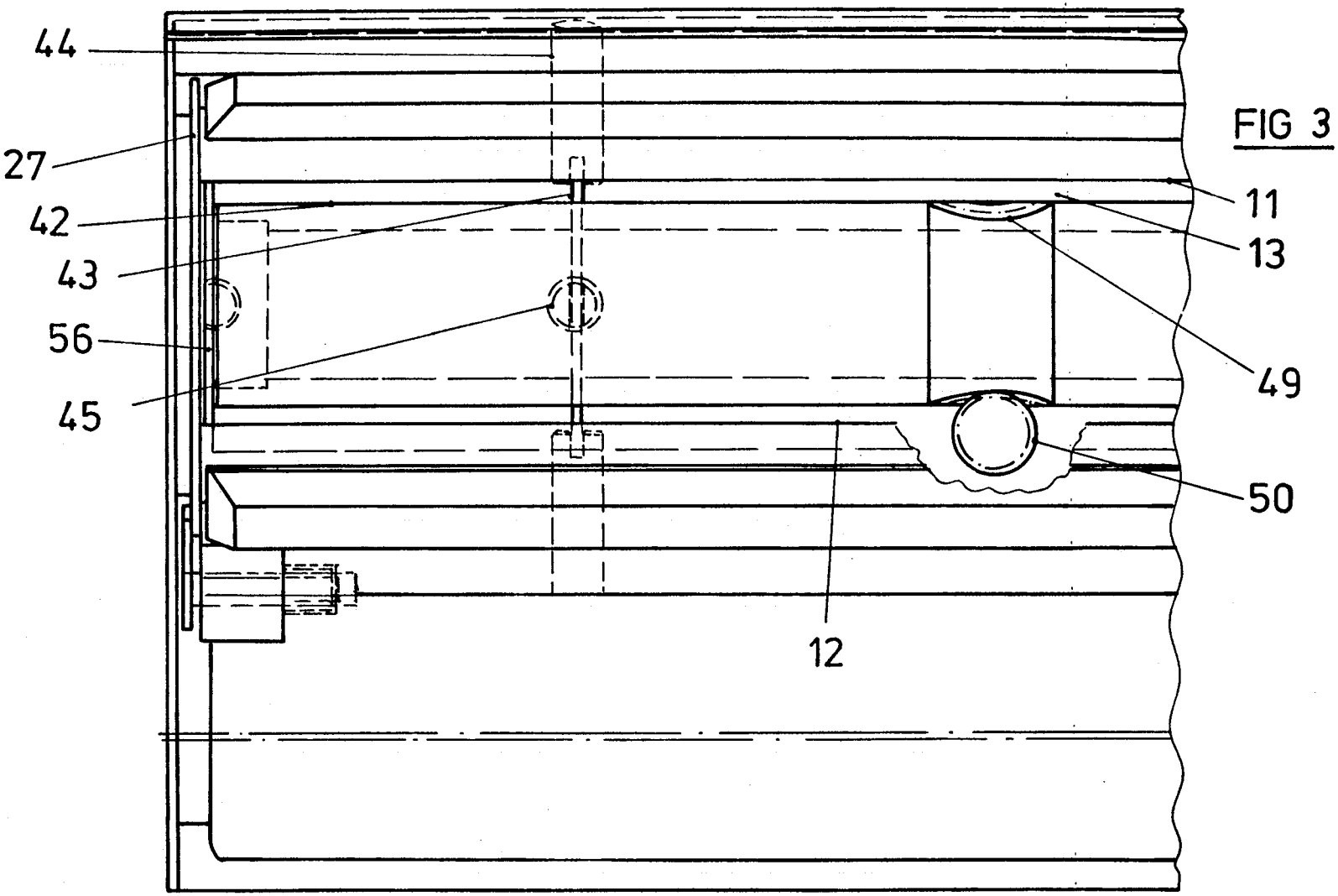
FIG. 3 is a plan view of the ink chamber doctor arrangement which is shown in FIG. 1.

As will best be seen from FIGS. 2 and 3, the ink chamber doctor unit comprises a beam-like doctor mount 9 carried on supports secured to the frame of the press. This mount carries two doctor blades 11 and, respectively, 12 which are mutually offset from each other in the direction or rotation of the associated pitted roll 3. They are held in place by jaws 10, which may be in the form of gripping jaws with the aid of which the respectively associated doctor blade 11 or 12 may be clamped against a suitable flange on the doctor mount 9. In the illustrated working example of the invention the jaws 10 are to cooperate with the respective flange of the doctor mount 9 to form a blade slot to receive the respective doctor blade 11 and, respectively, 12. The doctor blades may in this case be loosely fitted in the respective slot so that if they are heated during operation they will be able to expand in the longitudinal direction and even if there is only a gentle engagement force there will be no formation of corrugations in the blade. The mutually offset doctor blades 11 and 12 constitute, as considered in the direction of rotation of the pitted roll 3, the rear and front limits or walls of an ink chamber 4, whose radial limits are formed by the doctor mount 9, and, respectively, the periphery of the pitted roll 3 dipping into the ink chamber 13. At the ends the ink chamber 13 is shut off by sealing bars 27, which are pressed by abutments 34 against the ends of the doctor blades 11 and, respectively, 12.

In the present case the two doctor blades 11 and 12 are arranged symmetrically in relation to a median longitudinal plane containing the axis of the pitted roll 3 and they are inclined like the two surfaces of a roof in relation to each other. This symmetrical arrangement makes it possible to reverse the direction of rotation of the pitted roll 3 without affecting the operation of the doctor unit. The illustrated form of the invention shown here is designed for a counterclockwise direction of rotation of the pitted roll 3. The doctor blade 11 which is to the rear in terms of the direction of turning of the pitted roll 3 is arranged so as to engage the pitted roll 3 with a positive angle. The doctor blade 12, which is to the front in the direction of rotation of the pitted roll 3 is set at a negative angle of engagement. Even if the direction of rotation should be reversed the rear doctor blade will be then set at a negative angle and the doctor blade to the front in the direction of rotation will be set at a positive angle.

There is a charge of ink in the ink chamber 13 in order to apply ink to the pitted roll 3. The doctor blade 12, which is set at a negative angle and is to the fore in terms of the direction of rotation of the pitted roll, then functions as the main or working doctor which after inking of the surface of the pitted roll 3 wipes the lands 6 clean. The doctor blade, which is to the rear in terms of the direction of rotation of the pitted roll and is set at a positive angle, then functions as the fore or closing doctor blade, which strips off debris in the form of solidified ink and dirt such as dampening solution residues in the inking unit, adhering to the section of the circumference coming from the part in contact with the form roll 2. The ink then stripped from the roll may be returned to the ink chamber 13.

In order to ensure reliable inking of the pitted roll 3 there is a fountain roll 42 in the ink chamber 13 as delimited by the doctor blades 11 and 13. This fountain roll 42 engages the circumference of the pitted roll 3 along the full length of the ink chamber 13. The fountain roll 42 may be in the form of a metal or rubber roll. In the illustrated working example the roll is made of steel. The fountain roll 42 ensures that the ink chamber 13 does not have to be completely filled with ink under a gage pressure. In fact, it is sufficient to have a comparatively incomplete degree of filling of the ink chamber 13. Nevertheless the fountain roll 42 guarantees a complete and bubble-free filling of the pits 5 in the pitted roll 3. In this case then only a comparatively small amount of ink is in use, something that makes it possible to produce small single print surfaces at an econmical price. The fountain roll 42 extends along the full length of the respective ink chamber 13 and has its ends, as will best be seen from FIG. 3, engaging the sealing bars 27 or sheet metal supports 56 adjacent thereto. In order to radially support the fountain roll 42 there are half-shells 43 mounted in the ink chamber 13, in which the fountain roll 42 is supported circumferentially. The half-shells 43 are able to be radially adjusted like the sealing bars radially in relation to the pitted roll 3 so that in any event it is possible to ensure a reliable engagement of the fountain roll 42 on the pitted roll 3. For this purpose the half-shells 43 are guided at their edges by means of slotted pins 44 arranged in the doctor mount 9 and have an underlying setting device 45 respectively extending into the ink chamber 13. In the illustrated working example of the invention the pins 44 extend into the undercut ink chamber 13 so that the breadth of the half-shells 43 may be adapted to comply with the breadth of the narrowed chamber inlet this facilitating assembly. The setting device 45 has a respective thrust piston 46 acting on the respective half-shell 43 and which has a thrust spring 47 placed under it. In the illustrated form of the invention the thrust spring 47 bears against an externally operated setting screw so that if there has been wear of the doctor blade resetting of the force pressing against the fountain roll 42 will be possible.

The fountain roll 42 circumferentially borne in the half-shells 43 is driven in the illustrated form of the invention by means of a drive motor 48, which is mounted outside the ink chamber 13 on the doctor mount 9. The drive motor 48 is able to be reversed so that the fountain roll 42 may be driven in such a manner whatever the direction of the pitted roll 3 that there is opposite motion at the zone of roll contact and the ink is drawn into the contact slot between the pitted roll 3 and the fountain roll 42. The peripheral speed of the fountain roll 42 is however substantially smaller than the peripheral speed of the pitted roll 3 which is the same as the web speed.

In order to drive the fountain roll 42 the same is provided with a ring 49 of teeth machined into its periphery for meshing with a worm 50 arranged in the ink chamber 13 and set at a right angle to the axis of the fountain roll 24. Via a drive shaft 51 running out of the ink chamber 13 this worm is connected with the drive motor 48. The shaft 51 is sealed by means of a gland ring 52, having a spring thereunder, and which rests against the lower end face of the upright worm 50, to provide a sealing action with respect to a tube placed in the doctor mount 9, on which the drive motor may be flange mounted. The drive of the fountain roll 42 by way of a ring of teeth cut into its periphery leads to a simple mechanical design when it is a question of providing a number of adjacently placed ink chambers 13.

The doctor blade 11 operating as an upsteam doctor blade in the manner of operation shown in FIG. 2 wipes off ink from the pitted roll 3 and this ink is taken up by a gutter 53 formed on the doctor mount 9 and is led away. In the illustrated form of the invention the gutter 53 is connected via a drain hole 54 with the ink chamber 13 so that the wiped off ink from the pitted roll 3 is returned back to the ink chamber 13. The fountain roll 42 arranged in the ink chamber 13 ensures sufficient mixing of the recycled ink, which may be mixed with dirt, with the new fresh ink.

At the opposite doctor blade 12, which serves as the upstream blade when the pitted roll 3 is run in the opposite direction, there is also a gutter connected with the ink chamber 13 so that full reversibility is guaranteed. The ink chamber 13 is not under pressure in the present form of the invention, that is to say, no ink pump is needed. In fact, the ink may be simply poured into the ink chamber 13. For this purpose there is a filling funnel 55 molded on the doctor mount 9 to be seen on the left in FIG. 2 and which is connected with the ink chamber 13. The present arrangement accordingly operates with a comparatively small amount of ink, this leading to very low costs if only small areas are to be printed for example in the case of single print systems.

In the illustrated design it is only the doctor blade which is to the fore and which operates as the main blade, which is set at a negative angle. However it would naturally be possible to also arrange both doctor blades at a negative angle to the pitted roll if reversibility of the pitted roll is not desired.

We claim:

1. A printing press inking unit, comprising:

a pitted roll;

an ink chamber;

a fountain roll being provided within said ink chamber and extending over the length of said ink chamber, said fountain roll being circumferentially supported in said ink chamber;

a doctor mount;

two doctor blades, said doctor blades being mounted in a mutually offset manner on said doctor mount in a peripheral direction of said pitted roll so as to define said ink chamber;

half-shells mounted in said ink chamber, said half-shells each defining a circumferential bearing cup extending over 180° , said fountain roll being radially supported by said half-shells; and, means for setting said half-shells for movement in a direction toward said pitted roll and for setting said fountain roll against said pitted roll, said means for setting including means for biassing said half-shells in a direction toward said pitted roll.

2. The printing press inking unit according to claim 1, wherein said means for setting said half-shells in said ink chamber include a thrust piston for acting on at least one of said half-shells in which said half-shells have lateral guide edges which fit into associated guide grooves, and overlie said means for setting, said means for setting being provided in said doctor mount.

3. The printing press inking unit according to claim 2, wherein said thrust piston rests on a spring.

4. The printing press inking unit according to claim 3, wherein said means for setting includes a set screw for tensioning said spring, said spring bearing against said set screw.

5. The printing press inking unit according to claim 2, wherein said doctor mount includes pins extending into said ink chamber, said pins being provided with the guide grooves.

6. The printing press inking unit according to claim 1, wherein said fountain roll is operable at a speed of rotation less than that of said pitted roll.

7. The printing press inking unit according to claim 6, wherein said fountain roll is operable in the same direction as said pitted roll.

8. The printed press inking unit according to claim 1, further comprising:

a drive shaft;

a drive motor having said drive shaft, said drive motor being provided externally to said ink chamber;

a gear; and, gear teeth being provided for said fountain roll, said gear teeth being cut into the periphery of said fountain roll for cooperation with said gear in said ink chamber arranged perpendicularly to an axis of said fountain roll, said gear being connected by said drive shaft with said drive motor.

9. The printing press inking unit according to claim 8, wherein said gear is in the form of a worm and said gear teeth are worm gear teeth.

10. The printing press inking unit according to claim 8, further comprising:

a bushing mounted on said doctor mount with said drive shaft being operable in said bushing;

a spring; and, a gland ring having said spring acting thereon with said drive shaft being sealed by said gland ring.

11. The printing press inking unit according to claim 10, wherein said drive shaft is operable in said bushing mounted on said doctor mount and carries said drive motor.

12. The printing press inking unit according to claim 1, wherein said fountain roll is a metallic roll.

13. The printing press inking unit according to claim 1, wherein said ink chamber is provided with a filling opening.

* * * * *